US005823382A

United States Patent [19]

Van Giezen et al.

[11] Patent Number: 5,823,382

[45] Date of Patent: Oct. 20, 1998

[54] BASEPLATE FOR A PALLET CONTAINER

[75] Inventors: Maurice Gerardus Maria Van Giezen, Santpoort-Zuid; Harald Feijth, Utrecht, both of Netherlands

[73] Assignee: Koninklijke Emballage Industrie Van Leer B.V., Amstelveen, Netherlands

[21] Appl. No.: 860,166

[22] PCT Filed: Dec. 19, 1995

[86] PCT No.: PCT/NL95/00427

§ 371 Date: Jul. 10, 1997

§ 102(e) Date: Jul. 10, 1997

[87] PCT Pub. No.: WO96/19397

PCT Pub. Date: Jun. 27, 1996

[30] Foreign Application Priority Data

Dec. 19, 1994 [NL] Netherlands ..... 9402155

[51] Int. Cl.[6] ..... B65D 21/02

[52] U.S. Cl. ..... 220/571; 206/386; 206/508; 220/630; 220/636

[58] Field of Search ..... 220/571, DIG. 6, 220/630, 676; 206/386, 508, 598, 599, 503

[56] References Cited

U.S. PATENT DOCUMENTS

| | | | |
|---|---|---|---|
| 3,338,459 | 8/1967 | Smith . | |
| 4,690,299 | 9/1987 | Cannon . | |
| 5,253,777 | 10/1993 | Schultz | 220/571 |
| 5,316,174 | 5/1994 | Schultz | 220/571 |
| 5,346,094 | 9/1994 | Strawser | 220/571 |
| 5,429,236 | 7/1995 | Evans | 220/571 |
| 5,474,205 | 12/1995 | Lancaster | 220/571 |

FOREIGN PATENT DOCUMENTS

| | | |
|---|---|---|
| 0 509 228 | 10/1992 | European Pat. Off. . |
| WO 93/06027 | 4/1993 | WIPO . |

*Primary Examiner*—Joseph M. Moy
*Attorney, Agent, or Firm*—Frishauf, Holtz, Goodman, Langer & Chick, P.C.

[57] ABSTRACT

Baseplate (4) for a pallet container (1). The baseplate (4) is designed to accommodate the container section of a pallet container (1). To ensure run-off of the fluids which are present in the pallet container (1) towards an outflow opening with valve (6) close to a peripheral side of the pallet container (1), the baseplate (4) is constructed with a slope. This slope is such that, in the normal use position of the baseplate (4), this baseplate (4) is constructed with a downward slope to all sides from the center point of this place (4), whilst a peripheral gutter (13) is provided. The lowest point thereof is located at the outflow opening for the fluids.

8 Claims, 4 Drawing Sheets

BASEPLATE FOR A PALLET CONTAINER

BACKGROUND OF THE INVENTION

The present invention relates to a baseplate for a pallet container, which pallet container comprises a foot section with, arranged thereon, a container section for fluid products, the baseplate being equipped to support the container section and being shaped to correspond with the underside of the container section and being provided with at least one downward-sloping section running towards a recess in the base section, which recess is arranged to accommodate a valve for the container section.

A baseplate of this type is generally known in the prior art. In this context it is important to construct the baseplate in such a way that the container section which is supported by said baseplate and in general will have a base of the same shape is positioned such that the fluid present in said container runs towards the recess where a valve is arranged.

In European Application 0 509 228 it is proposed to construct the lowest point of the baseplate such that it is located in the centre, so that the fluid from the container always flows from the periphery towards the middle and from there moves, via a longitudinal channel which opens into the recess, towards the valve. In the vicinity of the raised periphery the baseplate is provided with a flanged section which faces downwards and the free end of which rests on the pallet foot.

Although a construction of this type is adequate from the standpoint of drainage of fluids, there is the disadvantage that a baseplate of this type must be of relatively heavy construction. Firstly, there is increased material consumption because of the flanged section. Said flanged section is necessary on the grounds of robustness. Because of the tapering towards the centre, there will be a tendency at this point, because of severe stress on the baseplate, for said baseplate to sag downwards, which necessitates additional robustness. This implies a further increase in material consumption. The baseplate must also provide protection against external influences, such as, for example, the tines of a fork-lift truck. The baseplate according to the prior art has an upward-sloping section, so that if the tines of, for example, the fork-lift truck come into contact with said upward-sloping section, the tines are guided upwards over the upward-sloping section and will then damage the unprotected part of the container section arranged on the baseplate.

Moreover, it has been found that it is complicated to produce a baseplate of this type.

SUMMARY OF THE INVENTION

The aim of the present invention is to provide a baseplate which can be produced relatively simply, a smaller amount of material being needed, so as, in this way, to reduce the costs of the pallet container (or IBC). The lower weight also improves the ease of handling of the pallet container.

This aim is achieved with a baseplate as described above in that the bearing surface of the baseplate is constructed such that it slopes downwards from the middle to the outer periphery and has gutter means around the periphery.

By making the baseplate of convex construction sloping downward towards the outside, that is to say constructing it such that the centre is the highest point, a force directed towards the outside will act when the baseplate is placed under load. If the baseplate is fixed at the periphery, the resistance to sagging will be increased, as a result of which the baseplate can be produced from a relatively weak material section. With the construction according to the invention, a gutter is formed around the periphery of the baseplate. A corresponding gutter is formed in the container section, by which means the discharge of fluid takes place via said gutter. With this arrangement both said gutter and the gutter in the baseplate are, of course, of such construction that said gutters are higher on the side remote from any valve than in the vicinity of the valve in order to make flow towards the valve possible. Because the baseplate according to the present invention is subjected to less deformation than is the baseplate according to the prior art, this baseplate can be produced from a sheet material of lower deep drawing grade. Moreover, the lesser movement of the sheet metal during deep drawing gives greater freedom to use a very thin material. The baseplate according to the present invention is particularly easily nestable, which is important during assembly.

According to an advantageous embodiment of the invention, the peripheral edge of the baseplate is constructed such that it slopes upwards from the gutter. As a result, on the one hand, the gutter described above is delimited and, on the other hand, the possibility is provided for achieving particularly simple fixing to a support construction. This support construction is fixed to the foot section of the pallet container. As a result of this fixing, it is possible to dispense with the additional amount of metal necessary in the case of the construction according to European Application 0 509 228, described above, which formed the flange edge facing downwards. As a result of the more robust construction of the baseplate according to the present invention, such a reinforcing edge is no longer necessary. Moreover, the baseplate can be fixed directly to the foot section or can rest thereon.

In order further to increase the rigidity of the baseplate according to the invention, ribs can be provided, which ribs are directed outwards and downwards. These ribs are preferably made such that the underside thereof is essentially horizontal. That is to say, the depth of the ribs close to the recess for the valve is less than that at the opposing side because of the downward slope of the baseplate. Horizontal ribs of this type can, moreover, function as a point of engagement for the lifting tines of a fork-lift truck.

Moreover, it is possible to construct at least one of these ribs such that it extends over the entire length from the one side to the other side of the baseplate. If this rib always has a substantial depth, it is possible to fit a reinforcing bar therein. A bar of this type can then be fixed to the support construction. The relevant sides located opposite one another are held together by said bar. This means that when a downward force is exerted on the baseplate, compression of the baseplate is counteracted.

The ribs are provided with discharge openings in order to remove any moisture and other fluid which has collected in the ribs, for example as a result of spillage when filling the container section.

The invention also relates to a container section to be fitted in a pallet container, wherein the underside has a shape which corresponds to that of the base section described above.

BRIEF DESCRIPTION OF THE DRAWINGS

The invention will be explained in more detail below with reference to an illustrative embodiment shown in the drawing. In the drawing.

DETAILED DESCRIPTION OF THE PREFERRED EMBODIMENT

Figure 1:
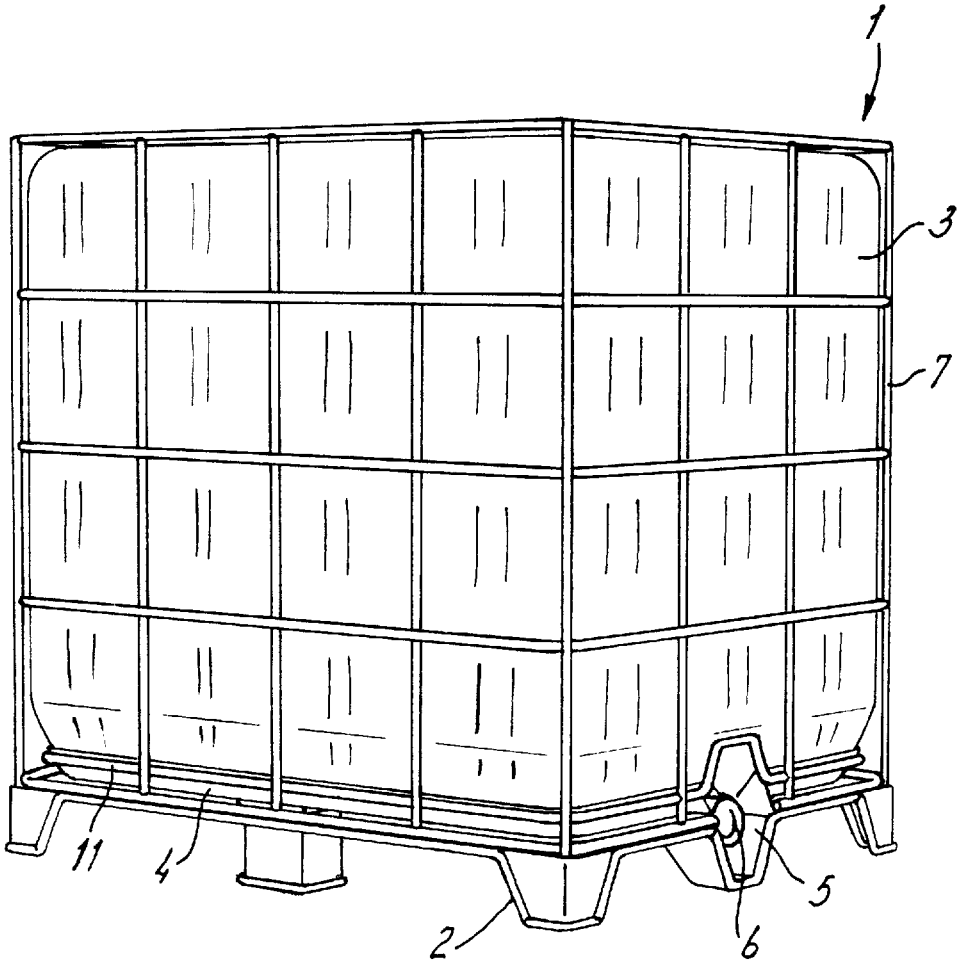
FIG. 1 shows a perspective side view of the pallet container according to the invention.

In FIG. 1, a pallet container is indicated by 1. A pallet container or IBC of this type is used for transporting all possible sorts of flowable products. Said pallet container consists of a foot section 2 and a container section 3. Container section 3 can comprise a blown moulded plastic container or bottle, around which a frame 7 of reinforcing rods has been fitted. Container section 3 rests on a baseplate 4 which, in turn, is fixed to peripheral rod 11 of frame 7. This is further shown in FIGS. 2 and 3. It can be seen from FIG. 3 that baseplate 4 is constructed such that at the centre c the distance from the bearing surface 12 of the container to the horizontal line a, indicated by A, is greater than the distance B or D in the vicinity of the periphery of the baseplate. That is to say, the baseplate is convex towards the centre. In order nevertheless to guarantee run-off of fluids in the container section 3, which has a corresponding base shape, towards recess 5 in which a valve 6 is located, a peripheral gutter 8 is provided. Of course, this peripheral gutter slopes downwards from right to left in FIG. 3 (D is greater than B), so that fluid flows from the rear of the baseplate or container section to recess 5 or valve 6. This, of course, assumes that the underside of the container has a shape corresponding to that of the bearing surface 12 and the gutters 8 of the baseplate.

Figure 2:
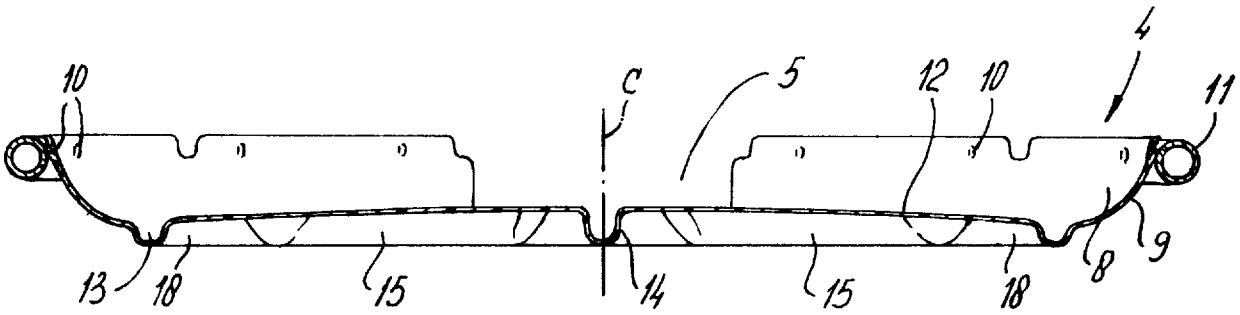
FIG. 2 shows a cross-section of the baseplate according to the invention fixed to a peripheral edge along the line II—II in FIG. 4.
Figure 3:
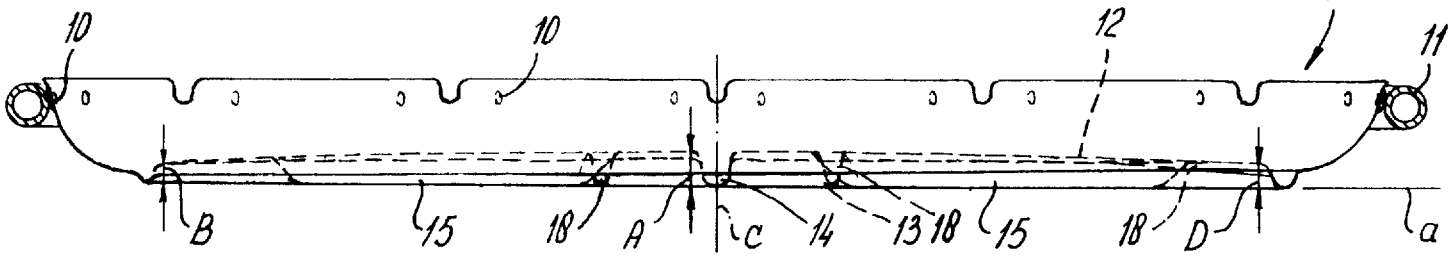
FIG. 3 shows a side view of the baseplate.
Figure 4:
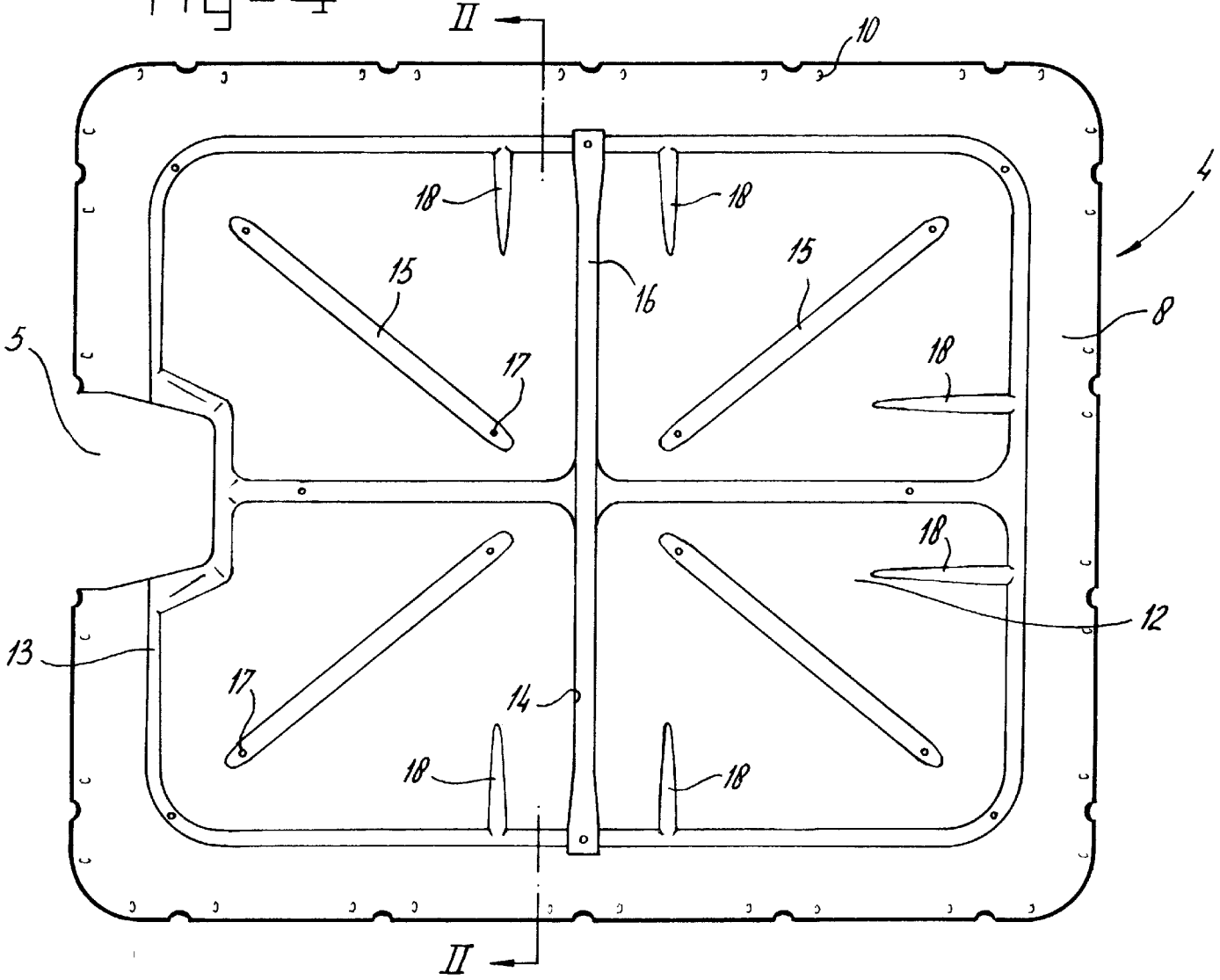
FIG. 4 shows a top view of the baseplate.

Moreover, it can be seen from FIGS. 2–4 that the gutter 8 is defined by a peripheral edge 9 and is provided with a ribs 13. The gutter 8 is provided with means for fixing to the peripheral rod 11 of the frame 7, such as projections 10, which make welding possible, or channels which make screwing possible. That is to say, the baseplate is mounted on the peripheral rod 11, where, as a result of the convex construction, a force directed outwards is exerted thereon under load. Because rod 11 forms a closed whole, said force can be relatively large without this resulting in any deformation. This results in that the baseplate can be of relatively lightweight construction.

Figure 5:
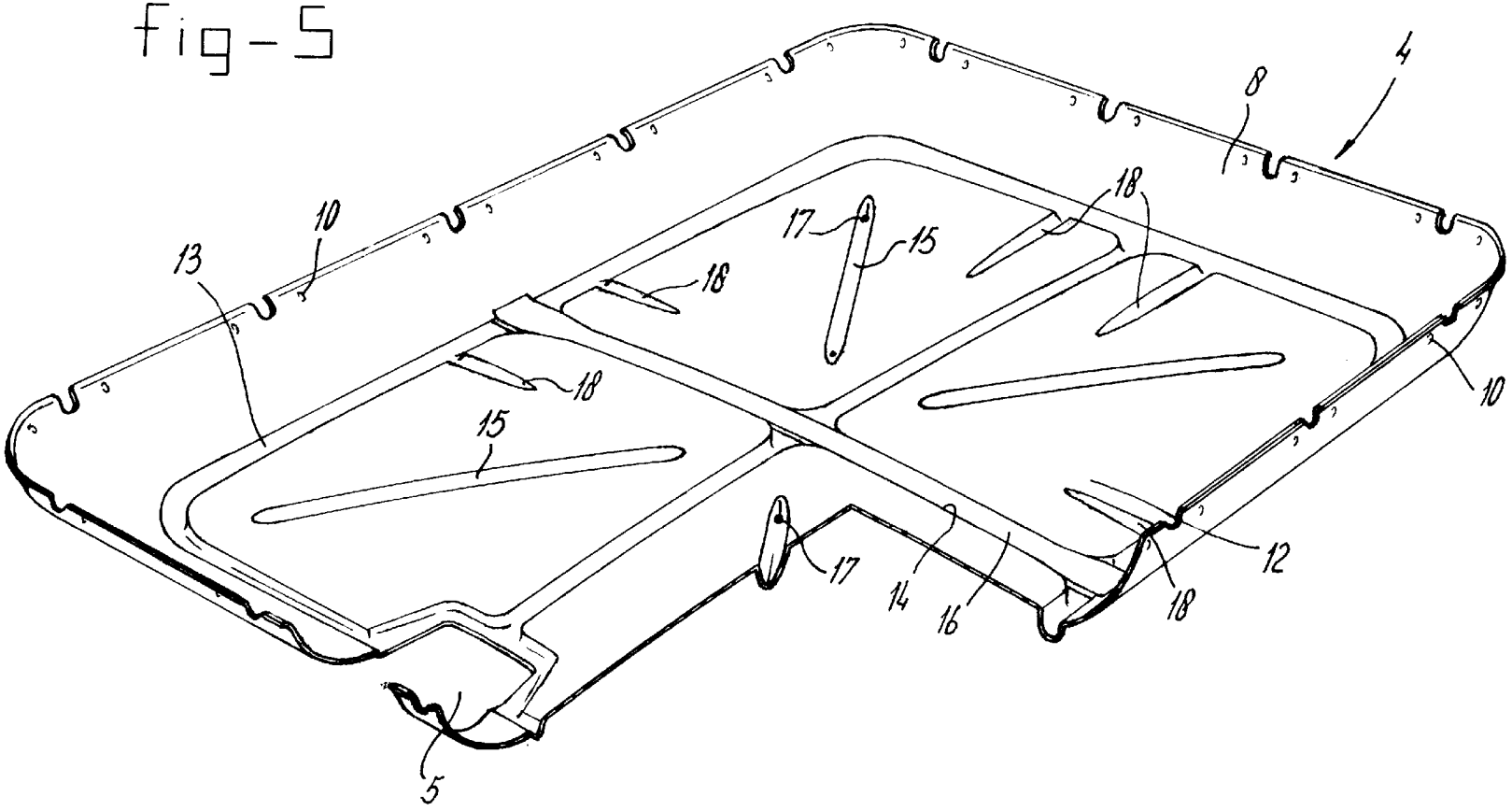
FIG. 5 shows a perspective view of part of the baseplate.

Ribs 13–15 are provided for further reinforcement and for engagement by, for example, the tines of a fork-lift truck. It will be understood that, because the baseplate slopes to one side, the height of the ribs varies. Thus, close to the centre C of the baseplate the rib at that point, indicated by 14, will be the highest. Close to the outlet opening, the ribs and the depression will be much shallower or not present at all, whilst at the opposite side ribs 13 has a height which is smaller. As can be seen from FIG. 5, various types of ribs are possible. Part-ribs which extend diagonally are indicated by 15. Openings 17 are present to provide for removal of, for example, rainwater. Furthermore, it can be seen that rib 14 extends from the one side to the other side of the baseplate. This rib is preferably constructed with a height such that a bar 16 can be placed therein, as is shown in FIG. 5. This bar can then be fixed to the underlying pallet foot. As a result of the fitting of such a bar 16, it is no longer necessary to fit a central support in the foot section 2 of the pallet container. Such a central support is always particularly vulnerable because damage rapidly occurs if the tines of a fork-lift truck are not introduced properly. This central support is not visible to the user of the fork-lift truck. If a central support is present, this can serve for direct support of the lowermost part of the gutter of the baseplate, as is shown in FIG. 5. Moreover, in the vicinity of the corner supports the relevant lower parts of the gutter can be supported by these corner supports.

The rib extending perpendicularly to rib 14 terminates in the gutter 8. It has been found that in this way adequate reinforcement is obtained with a very limited use of material.

The baseplate shown above is shown as a detachably fixed baseplate. This is important for re-use of the pallet container. Moreover, this makes it possible to form the latter from, for example, plastic.

Of course, permanent fixing of the baseplate to the peripheral rod, such as by welding, also falls within the scope of the present application.

These and other variants are considered to fall within the scope of the appended claims.

We claim:

1. A pallet container having a substantially rectangular periphery and including a foot section, a baseplate on the foot section and a container section supported on the baseplate, wherein said baseplate comprises:

a recess in a first side of the baseplate arranged to accommodate therein a valve for the container section;

a gutter at a periphery of the baseplate sloping in a downward direction toward said first side from a second side of the baseplate opposite thereto; and a bearing surface, on which the container section is supported, that slopes downwardly from a longitudinal center line to the periphery in a direction substantially perpendicular to said center line and ending in said gutter, wherein said center line extends between said first and second sides of the baseplate.

2. The pallet container according to claim 1, wherein a peripheral edge (9) is constructed with an upward slope to delimit the gutter (8).

3. The pallet container according to claim 2, wherein the upward-sloping peripheral edge (9) is fixed to a support construction (11), for the container section, fitted on the foot section.

4. The pallet container according to claim 1, provided with ribs (13–15) directed outwards and downwards.

5. The pallet container according to claim 4, wherein the ribs close to the recess (5) have a substantially smaller height than the ribs diametrically opposite said recess, or are not present at all.

6. The pallet container according to claim 1, wherein at least one rib in the baseplate forms a channel arranged from one side to the opposite side, in which a reinforcing bar (16) can be accommodated which is fixed to a support construction for the container section at corresponding sides.

7. The pallet container according to claim 4, wherein the ribs are provided with discharge openings (17).

8. The pallet container according to claim 1, wherein the container section has an underside shaped to fit said baseplate.

* * * * *